US006050569A

United States Patent [19]

Taylor

[11] Patent Number: 6,050,569

[45] Date of Patent: Apr. 18, 2000

[54] METHOD OF PLAYING A TILE-CARD GAME

[76] Inventor: Elizabeth Taylor, 7 Lawn Pl., Atlantic City, N.J. 08401

[21] Appl. No.: 09/113,408

[22] Filed: Jul. 10, 1998

[51] Int. Cl.[7] ..... A63F 1/00; A63F 9/20

[52] U.S. Cl. ..... 273/292; 273/303; 273/306; D21/378; D21/379; D21/381

[58] Field of Search ..... 273/292, 303–306; D21/378, 379, 381

[56] References Cited

U.S. PATENT DOCUMENTS

| | | | |
|---|---|---|---|
| 5,788,241 | 8/1998 | Ung | 273/292 |
| 5,857,677 | 1/1999 | Sum Chau | 273/292 |
| 5,931,472 | 8/1999 | Ko | 273/292 |

*Primary Examiner*—Benjamin H. Layno
*Attorney, Agent, or Firm*—Norman E. Lehrer

[57] ABSTRACT

The present invention consists of a card game in which the players make two card hands where each hand consists of two cards. A deck of thirty-two cards where the deck consists of fifteen ranking pairs lettered A through 0 and two Jokers is used. All of the cards also have a point value, i.e., a numerical value. The letter ranking pairs are the highest hands except for the two Jokers, which are the highest when together and make 99. When the Jokers are together, each has a point value of nine, but when they are separate, each is wild and is to be used as either a six or a three, but has no letter value. Aside from the two Jokers and the fifteen ranking pairs, there are six other combinations better than a point value. These combinations are called heart and diamond marriages and consist of matching one of the three highest point value cards (9, 8, and 7, which have a diamond symbol) with any of the two highest letter ranking cards, (A or B, which have a heart symbol) and rank accordingly: 9-A, 9-B, 8-A, 8-B, 7-A, and 7-B. Except for the Jokers (99), the highest point value is nine, because only the last digit is used when totaling the two cards. Whenever a point value is a tie, the highest ranking letter of the highest numbered card in each hand will determine the winner. If that letter is the same, the bank wins the hand. The bank also wins all zero point hands. A 5% commission is paid on all winning wagers and the bank rotates from dealer to players in a counter-clockwise direction.

2 Claims, 1 Drawing Sheet

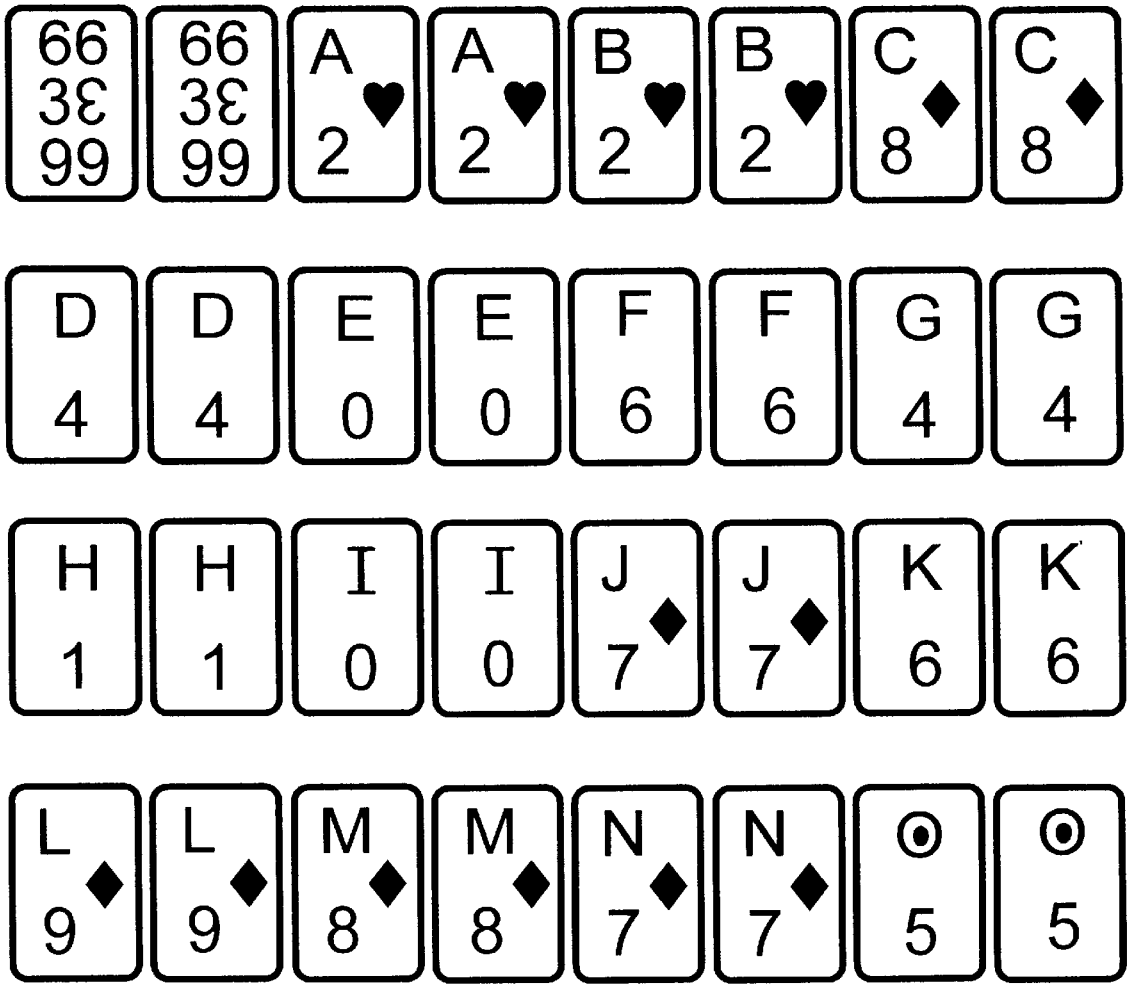
66 3Ɛ 99
66 3Ɛ 99
A ♥ 2
A ♥ 2
B ♥ 2
B ♥ 2
C ♦ 8
C ♦ 8
D 4
D 4
E 0
E 0
F 6
F 6
G 4
G 4
H 1
H 1
I 0
I 0
J ♦ 7
J ♦ 7
K 6
K 6
L ♦ 9
L ♦ 9
M ♦ 8
M ♦ 8
N ♦ 7
N ♦ 7
⊙ 5
⊙ 5

METHOD OF PLAYING A TILE-CARD GAME

BACKGROUND OF THE INVENTION

The present invention is directed toward a card game and more particularly, toward a modified method of playing the casino card game Pai Gow Poker and the Pai Gow Tile game.

Pai Gow Tiles is a game which has been played by Asian families in their homes for hundreds and hundreds of years as poker is played in American homes. It is also a well-known casino game played by mostly Asians in casinos across the United States today. Yet, the game has not been made to be easier understood and comprehensible by the English speaking public.

In the game of Pai Gow Tiles, there are 32 dominoes or tiles that make up sixteen pairs. These pairs are ranked in a predetermined order. Each tile has a numeric value determined by adding the spots on the tile. Each player is dealt two hands where each hand consists of two tiles. The object of the game is to set the tiles into two pairs for the best ranking combination which is determined by comparing the hand to a ranking chart. The point value of a hand is determined by adding the numeric value of each tile in a hand. The highest point value can only be nine because the last digit of the hand's total is used to determine the point value. There are 20 combinations higher than a point value.

Pai Gow Poker is a casino game which is played with one deck of fifty-two cards and one Joker. Each player is dealt seven cards which are arranged in two hands, one with five cards and the other with two hands. Hands are played and ranked as traditional poker hands. The object of the game is to have both hands rank higher than both hands of the banker. A foul and an automatic loss result whenever the hand with two cards is better than the card with five cards.

SUMMARY OF THE INVENTION

The present invention is a card game in which the players and the bank must set and win two card hands, where each hand consists of two cards, in order to win his or her wager. The cards are dealt out of a deck of thirty-two cards. The hands are compared to a pre-determined ranking system. The ranking system is similar to that used in the ancient Asian game of Pai Gow Tiles. The present invention, however, puts the game into commonly known orders and into a pattern which is easily comprehended by the English-speaking public.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

The FIGURE is a plan view of the thirty-two cards of the present invention.

DETAILED DESCRIPTION OF THE PREFERRED EMBODIMENT

Referring now to the drawing in detail, there is shown in the figure thirty-two cards designed in accordance with the principles of the present invention and designated generally as 10.

In the present invention there are thirty-two cards which include two Jokers and fifteen ranked pairs lettered A through 0 and randomly numbered one through nine. The Jokers are numbered 3 and 6, as will be discussed in more detail below. The cards numbered 7, 8, or 9 also have the symbol of a diamond. The cards lettered A or B also have the symbol of a heart. The order of rank, from highest to lowest is: two Jokers, fifteen ranked pairs, six marriages, and point value.

The highest ranking hand is the Jokers which make 99. When the Jokers are together they each have a point value of nine. When they are separate, they are wild and have a point value of six or three, each. The Jokers do not have a letter value.

The next highest hand is the ranked pairs. The pair lettered A is the highest and the pair lettered O is the lowest.

The next highest hand is the marriages. The marriages are made by matching an A or B heart card with a 9, 8, or 7 diamond card. (The marriages are similar to the Wongs and Gongs in the Pai Gow Tile game in that they are made by playing one of the two highest single ranking cards, A or B, with a 9, 8, or 7 but the present invention has made the connection obvious upon sight, by matching a heart with diamond, whereas they are not obvious in the game of Pai Gow Tiles.) Thus, the rank from highest to lowest is as follows: 9-A, 9-B, 8-A, 8-B, 7-A, and 7-B.

The lowest hand is the point value. Here, the numeric value of each card in a hand is added. The highest point value is nine. If the total has two digits, the last digit is used to determine the point value. When there is a point tie, the highest letter rank of the highest numbered card in each hand breaks the tie. If that letter is the same, the bank wins. The bank also wins all zero point hands.

In order to play the game, four cards are dealt to each player. The players arrange their cards in two pairs for the best ranking position. The players then compare their combinations to the predetermined ranking order in order to determine who wins.

The present invention varies from the Pai Gow Tile game in several ways. For example, in the present invention two combinations higher than a nine point value have been added which makes a total of twenty-two combinations instead of twenty, as in the Pai Gow Tile game. Those combinations are any diamond 7 with any A or B heart. (This is considered a High Nine in Pai Gow Tiles.) Also in the present invention, all the pairs match and are obvious upon sight, whereas in the game of Pai Gow Tiles the last four pairs do not even match, making the game very confusing.

Furthermore, in the present invention the symbols are put on cards instead of tiles dominoes. The cards are dealt in one style that is used in Pai Gow Poker when there is not an automatic shuffler.

In the present invention there are no fouls because both hands are two two-card hands. Also, there will be a dead hand spot that will be dealt to, unlike the game of Pai Gow Poker.

One procedure of dealing that may be used in the present invention is to deal eight four card stacks in front of the dealer. The dealer then shakes three die in order to determine which player will go first. The hands are placed in order in every player's spot, i.e., the six players, the dead hand, and the dealer. All dead hands will then be locked up and the players will then set hands. It should be noted, however, that the invention should not be limited to this form of dealing and that other methods of dealing may be used.

In the present invention, as in the Pai Gow Tile game and Pai Gow Poker, the bank will win all copy hands, as discussed above, and there will be a 5% commission charged on all winning wagers. The bank will also win on all zero hands. In the present invention, as in the game of Pai Gow Tiles, the banker position will rotate counterclockwise from dealer to player after the player has played against the house as bank. Also, the player may cover all wagers made or co-bank, i.e., where the dealer and player act as the bank on fifty-fifty basis.

As casinos are known to exchange advantages of a game, to make it more appealing, speed it up; or improve a house's edge. The following are exemplary of the house's options that are applicable in the present invention. Different alternatives may include, but are not limited to the house's options to: forfeit rotation of the bank for certain advantages; have copy hands be pushes; and have zeros not be an automatic loss and be treated as regular point hands. Also, when the ranking letter of the highest numbered card in a point tie is the same, the letter ranking of the second card will determine the tie instead of having a copy hand. For surrender of these advantages, it may be a casino's option to bank all hands.

Another option with this scenario would be for the house to bank all hands, but not to receive cards. Instead, the house may use a predetermined qualifier that the player's hands must beat in order to win a wager. For example, the hands must be better than 4 & 7 to win.

Furthermore, the present invention may be applied to electronic devices, including but not limited to, slot machines.

By the adoption of the English alphabet and English number system, which have been adjusted to meet an old Asian game pattern, and applied to cards, a new game has been invented. The fact that there are no other casino games which uses a ranking system similar to that which is used in Pai Gow Tiles is proof of the nonobviousness to one of ordinary skill in the art. That is, by transferring the tile ranking system into an easier and more comprehensible pattern by using symbols more familiar to the U.S. public, the present invention provides a new game.

The present invention may be embodied in other specific forms without departing from the spirit or essential attributes thereof and accordingly, reference should be made to the appended claims rather than to the foregoing specification as indicating the scope of the invention.

I claim:

1. The method of playing a card game comprising the steps of:

providing a deck of thirty-two cards including fifteen pairs lettered A through O;

dealing four cards to each player, said four cards forming two hands of two cards each;

arranging said hands for the best ranking combination; and comparing each of said hand to a predetermined ranking of cards.

2. The method of playing a card game as claimed in claim 1 wherein said deck of thirty-two cards includes two Jokers.

* * * * *